United States Patent [19]

Reed

[11] 4,162,140

[45] Jul. 24, 1979

[54] NOX ABATEMENT IN BURNING OF GASEOUS OR LIQUID FUELS

[75] Inventor: Robert D. Reed, Tulsa, Okla.

[73] Assignee: John Zink Company, Tulsa, Okla.

[21] Appl. No.: 836,379

[22] Filed: Sep. 26, 1977

[51] Int. Cl.[2] ..... F23C 1/08

[52] U.S. Cl. ..... 431/284; 431/175; 239/405; 239/425

[58] Field of Search ..... 431/174, 175, 284; 239/405, 425, 424, 423

[56] References Cited

U.S. PATENT DOCUMENTS

| | | | |
|---|---|---|---|
| 2,965,163 | 12/1960 | Lance et al. | 239/425 |
| 3,147,795 | 9/1964 | Livingston et al. | 431/174 |

*Primary Examiner*—Carroll B. Dority, Jr.
*Attorney, Agent, or Firm*—Head, Johnson & Chafin

[57] ABSTRACT

A burner system for burning gaseous or liquid fuel, comprises a primary burner system, which includes a liquid burner tube closed at one end and provided with a plurality of primary combustion ports symmetrically arranged to provide a plurality of jets forming a conical sheet of particles of fuel. Surrounding the liquid burner is a gas burner tube, which comprises the annular space between two coaxial tubes closed at the end, and including therein a plurality of primary combustion ports arranged symmetrically to provide jets arranged on the surface of a cone. Combustion air is drawn into the space around the gas burner tube, to supply combustion air for the liquid and/or gaseous fuel. Upstream of the primary combustion ports is a secondary burner which is circular in configuration, and surrounds, and is spaced from the gas burner tube. A limited quantity of gaseous fuel is supplied in the form of a circumferentially directed jet in the lee of an annular plate. The combustion air flows adjacent the secondary burner and the products of combustion of the gas in the secondary burner, flows with the air into the combustion zone of the primary burner, where the carbon dioxide and water serve to reduce any NOx that may be present in the combustion zone of the primary burner.

5 Claims, 4 Drawing Figures

NOX ABATEMENT IN BURNING OF GASEOUS OR LIQUID FUELS

CROSS-REFERENCE TO RELATED APPLICATION

This application is being filed contemporaneously with another application by the same inventor, Ser. No. 836,380, entitled "NOx ABATEMENT IN GAS BURNING WHERE AIR IS PREMIXED WITH GASEOUS FUEL PRIOR TO BURNING."

BACKGROUND OF THE INVENTION

1. Field of the Invention

This invention lies in the field of gaseous and liquid fuels burning systems. More particularly, it concerns the design of a burning system which can use either, or both, liquid fuel and gaseous fuel.

More particularly, it is concerned with a type of burner system in which the production of NOx is minimized.

One of the undesirable products formed as fuel burns is typically nitric oxide (NO) which readily reoxidizes to nitrogen oxide ($NO_2$). Because of the number of oxides of nitrogen that may form, they are commonly referred to as NOx. NOx, in the air, is a serious pollutant, which is the subject for EPA regulation, as to maximum emission to the atmosphere, in any case of venting of products of combustion to the atmosphere, as from a typical chimney or stack.

NOx emission is measured in parts per million (PPM) in stack gases, and some fuels, as they burn, are capable of generation of several hundred PPM. New EPA regulations, as proposed, will limit tolerable NOx emission to not more than one hundred PPM. Means for reduction of emitted NOx are demanded for fuel burning as fuel is typically burned.

2. Description of the Prior Art

In the prior art, the means for reduction of emitted NOx in the products of combustion of a furnace or stack, involves generally the cumbersomely and expensively recirculated flue gases from the stack or chimney, back into the combustion zone. This involves motor-driven fans and ducts to accomplish the recirculation of the high temperature combustion products to the combustion zone, of one or more burners.

A more recent development is illustrated by the U.S. Pat. No. 4,004,875, which utilizes the recirculation of products of combustion without, however, using the expensive construction of blowers and ducts, etc. However, none of the prior art systems utilize the simple feature of the present invention.

SUMMARY OF THE INVENTION

Generation of oxides of nitrogen, or NOx, which are air pollutants, is a characteristic of all fuels burning. It has been found impossible to completely stop all NOx generation in fuels burning, but it is possible to suppress it to a significant degree, in all cases, if the air for combustion is thoroughly mixed with combustion product gases, such as $CO_2$ and $H_2O$, prior to combustion. Without the combustion product gases addition to the air supply, the NOx concentration can be of the order of hundreds of PPM but, with added combustion gases, the NOx evolved becomes less than one hundred PPM.

The reduction of NOx is thought to be due to the presence of both, or either, $CO_2$ or $H_2O$ in the combustion air enroute to the combustion area to cause the typical reactions as follows:

$$CH_4+CO_2=2CO+2H_2$$

and $$CH_4+H_2O=CO+3H_2$$

Through these reactions the combustible partial pressure within the reducing areas of the flame is quadrupled and any NOx in the combustion area will be reduced considerably by this surplus of reducing agents. The NOx can generally supply oxygen for the support of combustion of the CO and $H_2$ to reduce the total NOx presence. No better explanation has been advanced for NOx reduction in this manner. However, the problem involved here is getting the $CO_2$ and $H_2O$ into the combustion air prior to major fuel burning. Cumbersome means for flue gas recirculation from stack burner is one expedient, but is an expensive one.

It is, therefore, a principal object of this invention to provide a simple, inexpensive and thermally efficient method of reducing NOx in the products of combustion of a burner system.

It is a still further object of this invention to provide a burner which can use liquid of gaseous fuel separately, or together, and still provide a means for minimizing the production of NOx.

It is still a further object of this invention to provide a burner system which produces a minimum quantity of NOx without the use of recirculation of products of combustion by means of blowers and conduits.

It is a still further object of this invention to provide a type of burner system for the minimization of NOx production, in which a secondary burner is utilized, which burns gaseous fuel, and which is positioned upstream of the primary burner, so that the products of combustion of the smaller secondary burner, utilizing gaseous fuel, mixes with the combustion air and travels downstream to, and mixes in the combustion zone with the flame of the primary burner.

These and other objects are realized and the limitations of the prior art are overcome in this invention by using a dual burner, which includes a liquid burner tube, and a gas burner tube supplied with pressurized liquid fuel, is closed at the distal end, and provided with a plurality of ports arranged to provide jets of fuel forming a conical surface, concentric with the liquid burner tube.

Surrounding the liquid burner tube is a gaseous burner tube, which comprises an annular space, between an inner tube and an outer tube, which are coaxial with and surround the liquid burner tube. The annular space is closed at the distal end and there is a plurality of ports for the flow of gas jets, which are directed outwardly and onwardly at a selected angle to form a conical sheet of gas.

These liquid and gas burner tubes and ports form a primary burner and primary burner ports. Upstream a selected distance from the primary burner ports is a secondary burner, to which gas is supplied in limited quantity, such as in the range of 10% to 30% in heating value of the fuel which is supplied to the primary burner system. The secondary burner can be in the form of a circular annular plate baffle, behind which gas is provided to burn quietly in the lee of the plate baffle. The gaseous combustion products of carbon dioxide and water from the secondary burner mix with the combustion air which passes around the outside of the burner system, and joins the conical sheets of fuel gas and/or fuel oil particles, in the primary combustion zone, and by the process of reducing any NOx which forms, provides a reduce PPM of NOx in the combustion gases which reach the stack.

BRIEF DESCRIPTION OF THE DRAWINGS

These and other objects and advantages of this invention and a better understanding of the principles and details of the invention will be evident from the following description taken in conjunction with the appended drawings, in which.

DESCRIPTION OF THE PREFERRED EMBODIMENT

Figure 1:
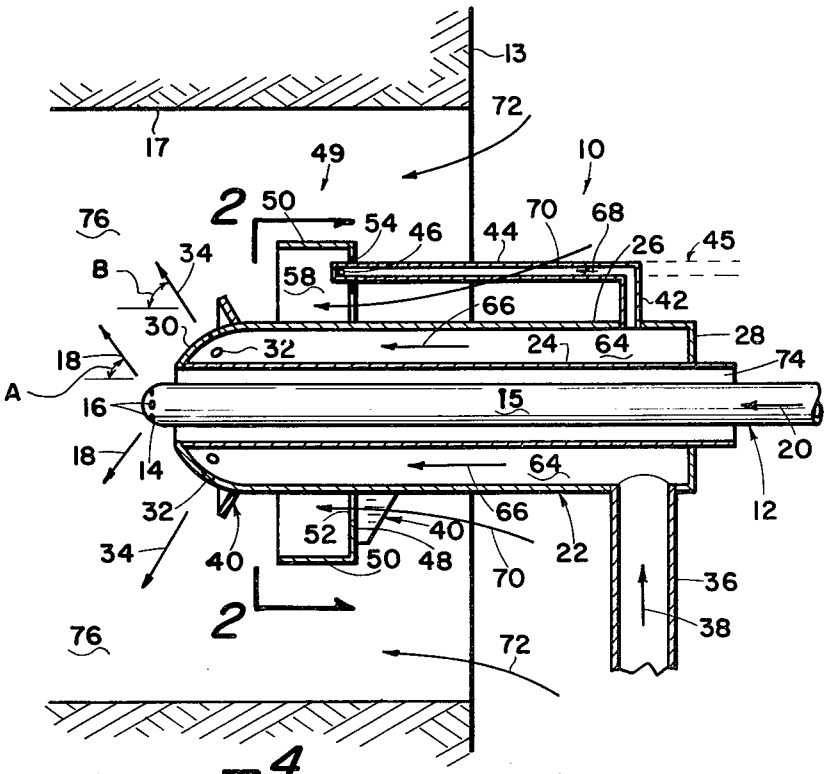
FIG. 1 illustrates, in cross-section, a side elevation of one embodiment of this invention.
Figure 3:
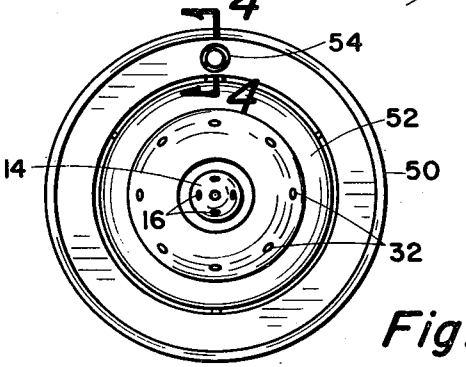
FIG. 3 illustrates a front elevational view of the apparatus of FIG. 1.
Figure 2:
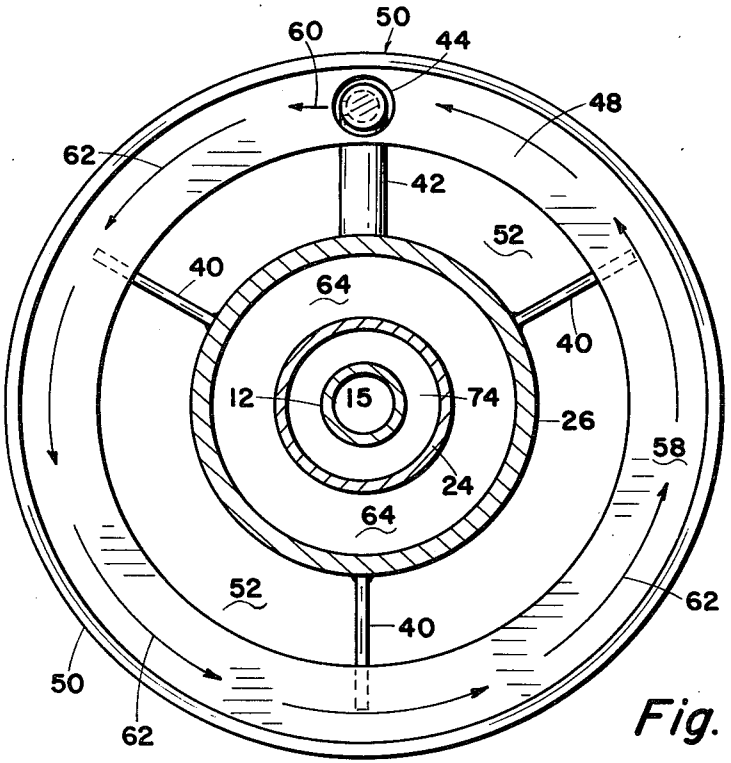
FIG. 2 is a sectional view taken along the line 2—2 of FIG. 1.

Referring now to the drawings and, in particular, to FIGS. 1 and 2, there is shown one embodiment of this invention, indicated generally by the numeral 10.

There is a liquid fuel burner 15 which comprises a burner tube 12 supplied with pressurized liquid fuel, in accordance with arrow 20, into the interior space of the liquid burner tube, which is closed at the distal end and supplied with a plurality of circumferentially-spaced ports 16, each of which is positioned in a radial plane, at an angle A to the axis of the burner tube. Under pressure, jets of fuel 18 will issue out of the ports 16 and will form a conical sheet of liquid droplets.

Surrounding, and slightly spaced from, the liquid burner tube 15 is the gaseous burner tube 22. This comprises an inner tube 24 of larger diameter than the liquid burner tube 12 and an outer tube 26, the annular space between which is closed at the distal end. The inner space 64 forms a conduit for the flow of gaseous fuel indicated by the arrows 66, which enters through a pipe 36, in accordance with arrow 38 from a source of pressurized gaseous fuel. The closed end 30 has a plurality of circumferentially spaced ports 32 through which jets of gas 34 will issue at high speed, and will form, more or less, a continuous conical wall of gas. The angle B of the jets 34 is preferably the same as the angle A of the jets 18.

Burner system 10 is provided with a mounting system, not shown, but which can be conventional, to support it axially within an opening 17 inside of a wall 13 of refractory material, as is well known in the art. The issuance of the fuel from the ports at high velocity, induces a flow of combustion air 70, 72 in the annulus between the burner system 10 and the inner wall 17 of the opening through the wall 13.

If desired, a circular annular flange 40 may be provided on the outer surface near the ports of the gaseous burner tube.

Situated a selected distance back from the primary burner ports of the burner tubes — that is, upstream of the fuel jets 18 and 34, is a secondary burner indicated generally by the numeral 49. This can be constructed in a number of ways. However, one embodiment is shown in the figures. This comprises an annular plate 48, which is of larger inner diameter than the tube 26 of the gaseous fuel burner. There is an outer cylindrical flange 50, of relatively short length attached to the circumference of the annular plate 48. The plate 48 is preferable perpendicular to the axis of the burner system. This plate can be supported by the radial ribs 40 as illustrated in FIGS. 1 and 2.

A limited supply of gaseous fuel is supplied by a pipe 44 parallel to the burner system, which passes through a small opening 54 in the plate 48. This pipe is supplied with gaseous fuel from any source, such as pipe 45, shown in dashed line, or it can be taken from the space 64 of the gas burner tubes by means of the radial pipe 42.

The induced airflow indicated by arrows 72 also includes a flow indicated by arrows 70, which flow in along the outer surface of the gaseous burner tube and inside of the opening 52 in the secondary burner. It also includes a flow in the annulus 74 between the liquid and gaseous fuel.

Figure 4:
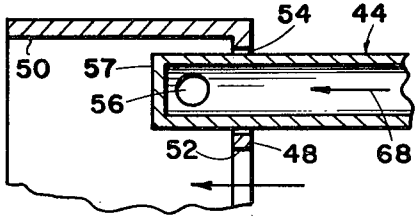
FIG. 4 illustrates a detail of the secondary burner system taken along the line 4—4 of FIG. 3.

Referring now to FIG. 4, there is shown an opening 56 in the side wall of the tube 44, just short of the end closure 57, so that gas flowing in accordance with arrow 68 in the tube 44 will flow tangentially as arrows 62 in FIG. 2.

Referring now to FIG. 2, it is seen that the jet of gas 60 flowing out of the opening 56 will flow in a circular pattern in accordance with arrows 62 in the lee of the annular plate 48 inside of the outer tubular flange portion 50. Combustion air is flowing through the opening 52 between the outer tube 26 of the gaseous burner tube and the inner edge of the plate 48 so that, in a quiet way, air diffuses into the gas and forms a quiet flame, which is stable, forming products of combustion, including carbon dioxide and water. The airflow 70, 72 carries these combustion products with it, into the combustion zone downstream of the jets of fuel 18 and 34. Thus, in the combustion zone 76, the formation of carbon monoxide and hydrogen will serve to reduce the NOx that may be present, to a selected minimum.

What has been described is a combination liquid and gaseous fuel burner, which can be utilized with one or both of the fuels. The basic improvement lies in the use of a secondary burner which surrounds the primary burner system and is upstream of the primary burner so that a supply of gaseous fuel to the secondary burner will provide combustion products of carbon dioxide and water, which flowing with the air into the combustion zone 76 of the primary burner will serve to reduce the NOx present.

The quantity of gaseous fuel burned in the burner 49 is a small part of the total fuel and may be of the order of 10% to 25%, with an optimum value in the range of 10% to 15% depending on the type of fuel use, etc.

It is clear also that the heat of combustion of the gas in the secondary burner 49 is carried by the products of combustion and the air supply 70 and 72 into the main combustion zone 76 and, therefore, is completely utilized in the operation of the furnace.

While the invention has been described with a certain degree of particularlity, it is manifest that many changes may be made in the details of construction and the arrangement of components. It is understood that the invention is not to be limited to the specific embodiments set forth herein by way of exemplifying the invention, but the invention is to be limited only by the scope of the attached claim or claims, including the full range of equivalency to which each element or step thereof is entitled.

What is claimed:

1. In a burner system for burning gaseous or liquid fuel, the improved construction for minimization of the production of NOx, comprising;

(a) a primary burner means comprising;

1. a liquid burner tube and means to supply liquid fuel under pressure to said liquid burner tube; said liquid burner tube closed at its distal end; said closure including a plurality of ports arranged symmetrically, each port in a radial plane, and at a selected angle A to the axis of said liquid burner tube;

2. a gaseous burner tube comprising a pair of coaxial tubes, with means to supply gas under pressure to the annular space between said two tubes; the annular space closed at the distal end; said closure including a plurality of ports arranged symmetrically, each port in a radial plane, and at a selected angle B to the axis of said gaseous burner tube;

(b) means to supply combustion air around the outer surface of said gaseous burner tube;

(c) secondary burner means surrounding said gaseous burner tube, and upstream a selected distance from said ports, and means to supply a selected quantity of secondary gaseous fuel to said secondary burner means to form a whirling annulus of flame about said gaseous burner tube, an annular opening between said gaseous burner tube and said secondary burner means;

whereby said secondary burner means utilizes part of said combustion air to burn said secondary gaseous fuel;

whereby the products of combustion of said secondary fuel burning, move with said combustion air downstream, into the zone of combustion of said primary combustion means.

2. The system as in claim 1, in which said selected quantity of secondary fuel burning comprises an energy rate in the range of 10% to 25% of the energy rate of said fuel, to said primary burner means.

3. The system as in claim 2 in which said percentages are in the range of 10% to 15%.

4. The system as in claim 2 in which said angles A and B are substantially equal.

5. The system as in claim 1 in which said secondary burner means comprises;

(a) an annular plate coaxial with, and in a plane substantially perpendicular to, and surrounding and spaced from, said gaseous fuel burner tube;

(b) a short cylindrical tubular flange attached and sealed to the outer circumference of said annular plate, and extending downstream thereof; and (c) means to provide a circumferential flow of gaseous fuel in the downstream angle of said secondary burner means.

* * * * *